US009157712B2

(12) United States Patent
Huang et al.

(10) Patent No.: US 9,157,712 B2
(45) Date of Patent: Oct. 13, 2015

(54) ENVIRONMENTALLY FRIENDLY BIODEGRADABLE BB PELLET AND MANUFACTURING METHOD THEREOF

(71) Applicant: Minima Technology Co., Ltd., Taichung (TW)

(72) Inventors: Chien-Ming Huang, Taichung (TW); Yu-Kai Huang, Taichung (TW); Cian-Jhong Huang, Taichung (TW); Jian-Shiun Chen, Taichung (TW)

(73) Assignee: MINIMA TECHNOLOGY CO., LTD., Taichung (TW)

( * ) Notice: Subject to any disclaimer, the term of this patent is extended or adjusted under 35 U.S.C. 154(b) by 101 days.

(21) Appl. No.: 14/152,445

(22) Filed: Jan. 10, 2014

(65) Prior Publication Data

US 2015/0198427 A1 Jul. 16, 2015

(51) Int. Cl.

| | |
|---|---|
| ***F42B 6/10*** | (2006.01) |
| ***F42B 7/04*** | (2006.01) |
| ***F42B 12/74*** | (2006.01) |
| ***F42B 12/72*** | (2006.01) |

(52) U.S. Cl.

CPC . *F42B 6/10* (2013.01); *F42B 12/72* (2013.01); *F42B 12/745* (2013.01); *F42B 7/04* (2013.01); *F42B 7/046* (2013.01)

(58) Field of Classification Search

CPC ..... F42B 6/10; F42B 7/04; F42B 7/046; F42B 12/72; F42B 12/74; F42B 12/745

USPC ..... 102/501, 502, 448; 86/54, 57

See application file for complete search history.

(56) References Cited

U.S. PATENT DOCUMENTS

| | | | | |
|---|---|---|---|---|
| 5,009,165 | A * | 4/1991 | Morris | 102/513 |
| 6,199,311 | B1 * | 3/2001 | Foster | 43/1 |
| 2007/0240601 | A1 * | 10/2007 | Chou et al. | 102/502 |
| 2008/0163779 | A1 * | 7/2008 | Campo et al. | 102/502 |

* cited by examiner

*Primary Examiner* — James S Bergin

(74) *Attorney, Agent, or Firm* — WPAT, P.C.; Anthony King

(57) ABSTRACT

A biodegradable BB pellet includes an organic material and an inorganic material. Therein, the organic material includes a main ingredient polybutylene-1,4-succinate, while the inorganic material is selected from pulvis talci powder, calcium carbonate, barium sulfate, mica powder, and zinc powder. The manufacturing method of the present invention is mixing the organic material and the inorganic material into a mixture, and processing the mixture orderly through injection molding, grinding, waxing and polishing. Thereby, the present invention is degradable by the environment and prevented from polluting environment. Also, due to the properties of better toughness, flexibility, and higher heat tolerance, the present invention is prevented from bursting to hurt other people and deforming during long-distance transportation.

13 Claims, 2 Drawing Sheets

ENVIRONMENTALLY FRIENDLY BIODEGRADABLE BB PELLET AND MANUFACTURING METHOD THEREOF

BACKGROUND OF THE INVENTION

1. Field of the Invention

The present invention relates to BB pellets, and more particularly, to an environmentally friendly biodegradable BB pellet, which can be degraded by the natural environment, whereby pollution upon organism and environment are prevented.

2. Description of the Related Art

Current BB pellets existing in the market are mostly made of 60 percent of stone powder and 40 percent of petrochemical plastic, wherein the petrochemical plastic is selected from polystyrene (PS) or polypropylene (PP), which is not degradable in the natural environment. As a result, if individual or groups engaging in sports activities of air-guns do not collect the BB pellets in the environment after finishing the activities, the BB pellets may easily pollute the environment or be hazardously eaten by wild birds. Therefore, BB pellets manufacturers began to develop biodegradable BB pellets for solving the hazardous pollution caused by petrochemical plastic BB pellets upon the environment.

Current biodegradable BB pellets are mainly produced in a manner of substituting the petrochemical plastic used by ordinary known BB pellets with biodegradable plastic, wherein the biodegradable plastic is mostly poly lactic acid (PLA). However, although poly lactic acid is a biodegradable material which can be degraded by the natural environment and prevent the pollutions upon organism and environment, the glass transition temperature (Tg) of the poly lactic acid is about 60 degree Celsius, and the poly lactic acid is highly rigid and brittle. As a result, when being fired, such BB pellets easily breaks or bursts and thus hurts surrounding people. In addition, the heat deflection temperature (HDT) of the poly lactic acid is about 58 to 60 degree Celsius, and the heat tolerance of the poly lactic acid is relatively low. As a result, such BB pellets may deform due to possible high temperature during the transportation, so a heat insulating device or refrigerated cabinet is needed for being transported, causing inconvenience.

SUMMARY OF THE INVENTION

For improving aforementioned difficulties, the present invention discloses a biodegradable BB pellet and manufacturing method thereof. The BB pellet of the present invention is highly tolerant toward low and high temperature, tough and brittleness-proof under normal temperature, and prevented from deforming during long-distance transportation.

For achieving the objective, the present invention provides a biodegradable BB pellet and manufacturing method thereof, wherein the biodegradable BB pellet comprises:

an organic material, and an inorganic material.

Therein, the organic material comprises polybutylene-1,4-succinate (PBS) as a main ingredient, and the inorganic material is selected from the group consisting of pulvis talci powder, calcium carbonate, barium sulfate, mica powder, and zinc powder.

The manufacturing method of the biodegradable BB pellet of the present invention comprises: mixing the organic material and the inorganic material according to a certain ratio into a mixture; and processing the mixture through injection molding, grinding, waxing, and polishing.

The primary objective of the present invention is to apply PBS as the main ingredient of the organic material. By use of the biodegradable property of PBS, the BB pellet of the present invention is allowed to be degraded in the natural environment, thereby preventing the environment from being polluted and the health of wild birds from being damaged.

The secondary objective of the present invention is that the BB pellet of the present invention possesses a higher toughness and relatively flexible texture due to the glass transition temperature (Tg) of PBS at −30 Degree Celsius. As a result, the BB pellet of the present invention is prevented from bursting to hurt people after being fired. Also, the heat deflection temperature (HDT) of PBS is 90 degree Celsius; therefore, the BB pellet is prevented from deforming due to possible high temperature during long-distance transportation.

DETAILED DESCRIPTION OF THE INVENTION

Other and further advantages and features of the present invention will be understood by reference to the description of the preferred embodiment in conjunction with the accompanying drawings.

Figure 1:
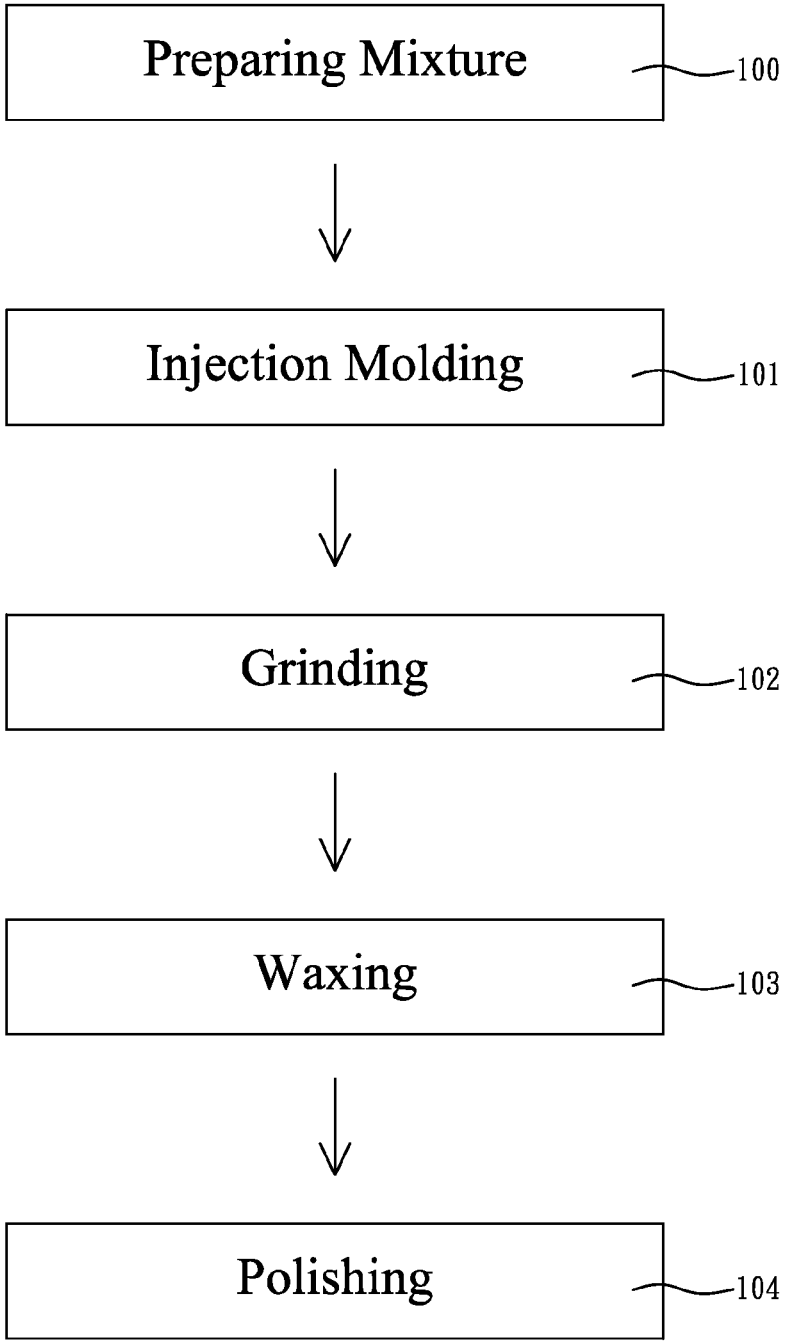
FIG. 1 is a flow chart of manufacturing method in accordance with the present invention.
Figure 2:
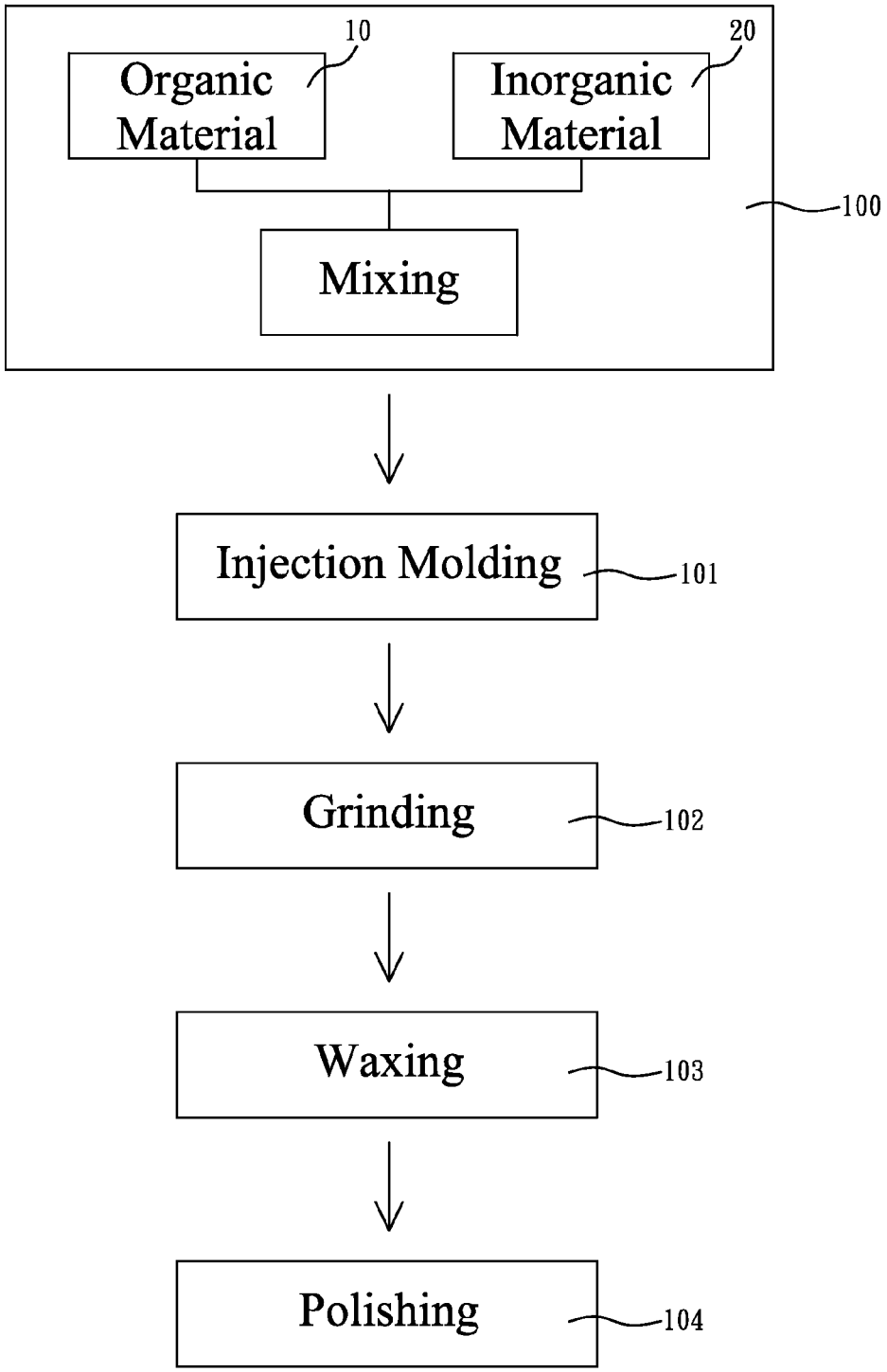
FIG. 2 is another flow chart of manufacturing method in accordance with the present invention.

Referring to FIG. 1 and FIG. 2, the biodegradable BB pellet of the present invention may be prepared through the method described below:

(a) preparing a mixture 100 by mixing an organic material 10 and an inorganic material 20 by a blender;

(b) injection molding 101 the prepared mixture 100 into a BB pellet;

(c) grinding 102 the injection molded 101 BB pellet;

(d) waxing 103 the grinded 102 BB pellet; and (e) polishing 104 the waxed 103 BB pellet.

Therein, regarding step (a), which is the process of preparing the mixture 100, the organic material 10 is present in an amount of 15 wt %-51% based on the total weight of the mixture 100 and the inorganic material 20 is present in an amount of 49 wt %-85 wt % based on the total weight of the mixture 100, while the organic material 10 is made of a main ingredient present in an amount of 70 wt %-100 wt % and a secondary ingredient present in an amount of 0 wt %-30 wt %, and the inorganic material 20 is selected from the group consisting of pulvis talci powder, calcium carbonate, barium sulfate, mica powder, and zinc powder, wherein the main ingredient of the organic material 10 is polybutylene-1,4-succinate (PBS) and the secondary ingredient of the organic material comprises poly lactic acid (PLA), polybutylene adipate-co-terephthalate (PBAT), a compatibilizer, and a coupling agent. Therein, PLA of the secondary ingredient is present in an amount of 0 wt %-20 wt % based on total weight of the organic material 10; the compatibilizer is selected from the group consisting of polyethylene glycol (PEG), polypropylene glycol (PPG), and glycerol; the coupling agent is selected from monoalkoxy titanium series compounds, such as alkoxy trimethacryl titanate, isopropyl dimethacryl isostearoyl titanate, and isopropyl triisostearoyl titanate;

Dynamic property of PBS is similar to the dynamic property of linear low-density polyethylene (LLDPE). Compared with other biodegradable materials, the dynamic property of PBS is relatively superior. In addition, the HDT of PBS is about 90 degree Celsius. Therefore, the mixture 100, prepared by use of the organic material 10 comprising PBS as the main ingredient, possesses extremely high heat tolerance and is unlikely to deform. Also, the glass transition temperature (Tg) of PGS is −30 degree Celsius, so the mixture 100 possesses relatively high toughness and flexible texture, thereby being prevented from bursting;

Furthermore, by adding PLA into the mixture 100, rigidity of the mixture 100 is increased, thereby facilitating the process of grinding and enhancing the size stability of the finished BB pellet under normal temperature. PBAT is added to adjust the toughness and flexibility of the products made of the mixture 100, whereby the resilience of the finished BB pellet is increased. Besides, compatibilizer increases the compatibility among PBS, PLA and PBAT. The inorganic material 20 increases the weight of the whole mixture 100. The coupling agent enhances the dispersion of the inorganic material 20, whereby PBS is easier to be combined with the inorganic material 20.

In the present invention, the mixture 100 is simply made of PBS as the organic material 10 added with the inorganic material 20; however, the mixture 100 comprises PBS as the main ingredient and PLA as a part of the secondary ingredient, whereby the finished BB pellet possesses higher heat tolerance, rigidity, and visual quality. By use of PBAT, the toughness and flexibility are higher, thus unlikely to burst.

Regarding step (b), which is the process of injection molding 101, the mixture 100 is put in an injection molding machine and then injected into a BB pellet mold. Known biodegradable BB pellet made of PLA as the main ingredient has a temperature for injection about 180-210 degree Celcius. In contrast, the temperature for injection of the present invention is about 160-190 degree Celcius. With PBS as the main ingredient and a relatively low temperature of injection, the present invention possesses advantages of power saving and fast cooling, thus being economical.

Regarding step (c), which is the process of grinding 102, the injection molded 101 BB pellet is grinded 102 with known grinding skills into a BB pellet with a diameter of 6.03 mm±1%, wherein the temperature of the cooling water used in the process of grinding 102 is about 15-25 degree Celsius.

Regarding step (d), which is the process of waxing 103, the grinded BB pellet, due to a relatively flexible texture, is allowed to be waxed 103 with ordinary aqueous wax.

Regarding step (e), the process of polishing 104, the waxed 103 BB pellet is polished 104 with known polishing skills into the biodegradable BB pellet with a diameter of 5.95 mm of the present invention.

The biodegradable BB pellet and the manufacturing method thereof are explained. The comparison of the physical properties, advantages, and disadvantages between the known BB pellet made of PLA as the main ingredient and the BB pellet of the present invention is described below.

Four biodegradable BB pellet products, made according to the manufacturing method of the present invention, are listed with different product number as shown in Table 1, which shows the weight percentage of the organic material 10 and inorganic material 20 in each product.

TABLE 1

Weight percentage of the organic material and inorganic material in four products

| | MEB-20 | MEB-25 | MEB-28 | MEB-30 |
|---|---|---|---|---|
| Organic Material | 51% | 32% | 25% | 20% |
| Inorganic Material | 49% | 68% | 75% | 80% |

Referring to Table 2, a comparison of physical properties between a BB pellet product made of PLA as the main ingredient and the four BB pellet products made according to the present invention is shown in Table 2.

| Physical Properties | Unit | ASTM | PLA BB Pellet/ MEB-20 | PLA BB Pellet/ MEB-25 | PLA BB Pellet/ MEB-28 | PLA BB Pellet/ MEB-30 |
|---|---|---|---|---|---|---|
| Impact Tolerance 23° C. | J/m Izod Notched | D-256 | 26/41 | 21/36 | Crack/34 | Fail to Form/31 |
| HDT | ° C. 4.6 kg/cm2 | D-648 | 58/97.4 | 58/95.1 | 58.5/101.8 | Fail to Form/97.6 |
| Fluidity Index | 190° C./ 216 kg g/10 min | D-1238 | 9.1/17 | 8.2/12.74 | 5.3/11.75 | Fail to Form/14.75 |
| Weight Ratio | g/cm3 | D-792 | 1.86/1.86 | 2.26/2.26 | 2.54/2.54 | Fail to Form/2.7 |

As BB pellet products in accordance with the present invention, MEB-20 has a weight ratio of 1.86 g/cm3, MEB-25 has a weight ratio of 2.26 g/cm3, MEB-28 has a weight ratio of 2.54 g/cm3, and MEB-30 has a weight ratio of 2.7 g/cm3. According to Table 2, if PLA is applied for producing a BB pellet with high weight ratio, due to the high rigidity and insufficient flexibility, the organic material 10 with PLA as the main ingredient is unable to efficiently coat the inorganic material 20. As a result, the BB pellet mixture thus made is prevented from being pelletized. Therefore, PLA is not suitable for making BB pellet with high weight ratio, such as 2.7 g/cm3 or higher.

Comparing other PLA BB pellets with weight ratio of 1.86 g/cm3, 2.26 g/cm3, and 2.54 g/cm3 and the BB pellet of the present invention, while under the same weight ratio, the BB pellet of the present invention possesses higher impact tolerance strength and higher resilience, thereby prevented from bursting to hurt people. Besides, the HDT of the BB pellet of the present invention is higher, which represents a higher heat tolerance, thereby being unlikely to deform. In addition, the fluidity index of the present invention is higher, which means that the BB pellet of the present invention is easier to be injected during the process of injection molding 101, allowing the temperature for injection to be lower, and causing the BB pellet to cool down sooner. Therefore, the manufacturing process of the BB pellet of the present invention is time-saving and more economical than the manufacturing process of PLA BB pellet.

In short, the present invention provides a biodegradable BB pellet and manufacturing method thereof, which applies polybutylene-1,4-succinate (PBS) as the main ingredient of the organic material 10. By use of the biodegradability of PBS, the BB pellet of the present invention is degradable in the natural environment, and thus prevented from causing environmental pollution and affecting the health of wild birds. Also, compared with PLA BB pellet, the BB pellet of the present invention possesses higher toughness and flexibility, so the BB pellet is prevented from bursting to hurt people after being fired. In addition, the manufacturing method of the present invention is allowed to produce BB pellet with high weight ratio, which is not achievable by known arts using PLA as the main ingredient.

Furthermore, the BB pellet of the present invention possesses a relatively high fluidity, whereby the temperature for injection is lower and the product cools down easier. Also, the heat tolerance of the BB pellet of the present invention is higher than the heat tolerance of PLA BB pellet, whereby the BB pellet of the present invention is unlikely to deform due to high temperature, thus unnecessary to be covered with heat insulating device or put in refrigerated cabinet during long-distance transportation. Therefore, the BB pellet of the present invention is more convenient for being transported, and the manufacturing process of the BB pellet of the present invention is time saving and more economical than the manufacturing process of known biodegradable PLA BB pellets.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An environmentally friendly biodegradable BB pellet, comprising:

an organic material including a main ingredient and a secondary ingredient, wherein the main ingredient is polybutylene-1,4-succinate (PBS) and the secondary ingredient includes poly lactic acid (PLA) and polybutylene adipate-co-terephthalate (PBAT); and an inorganic material.

2. The environmentally friendly biodegradable BB pellet of claim 1, wherein the organic material is present in an amount of 15 wt %-51 wt % and the inorganic material is present in an amount of 49 wt %-85 wt % based on the total weight of the BB pellet.

3. The environmentally friendly biodegradable BB pellet of claim 1, wherein the secondary ingredient comprises a compatibilizer, and a coupling agent.

4. The environmentally friendly biodegradable BB pellet of claim 3, wherein the compatibilizer is selected from the group consisting of polyethylene glycol (PEG), polypropylene glycol (PPG), and glycerol.

5. The environmentally friendly biodegradable BB pellet of claim 3, wherein the coupling agent is selected from monoalkoxy titanium series compounds.

6. The environmentally friendly biodegradable BB pellet of claim 1, wherein the main ingredient is present in an amount of 70 wt %-100 wt % and the secondary ingredient is present in an amount of 0 wt %-30 wt %, based on the total weight of the organic material.

7. The environmentally friendly biodegradable BB pellet of claim 1, wherein the poly lactic acid (PLA) is present in an amount of 0 wt %-20 wt % based on the total weight of the organic material.

8. The environmentally friendly biodegradable BB pellet of claim 1, wherein the inorganic material is selected from the group consisting of pulvis talci powder, calcium carbonate, barium sulfate, mica powder, and zinc powder.

9. The environmentally friendly biodegradable BB pellet of claim 1, wherein the organic material and the inorganic material are mixed into a mixture, and the mixture is processed through injection molding.

10. The environmentally friendly biodegradable BB pellet of claim 9, wherein the temperature for the mixture to be injection molded is about 160-190 degree Celsius.

11. The environmentally friendly biodegradable BB pellet of claim 9, wherein the mixture is processed through grinding and polishing.

12. The environmentally friendly biodegradable BB pellet of claim 11, wherein the temperature of cooling water needed during the grinding process is about 15-25 degree Celsius.

13. The environmentally friendly biodegradable BB pellet of claim 9, wherein the mixture is processed through waxing.

* * * * *